United States Patent [19]

Toyama

[11] Patent Number: 4,760,623

[45] Date of Patent: Aug. 2, 1988

[54] HINGE

[75] Inventor: Hiroaki Toyama, Yamanashi, Japan

[73] Assignee: Kabushiki Kaisha Murakoshi Seiko, Tokyo, Japan

[21] Appl. No.: 921,531

[22] Filed: Oct. 22, 1986

[30] Foreign Application Priority Data

Mar. 20, 1986 [JP] Japan ..... 61-41508[U]
Mar. 20, 1986 [JP] Japan ..... 61-41509[U]

[51] Int. Cl.[4] ..... E05D 7/04; E05D 7/06; E05D 7/12

[52] U.S. Cl. ..... 16/238; 16/246; 16/258; 16/288; 16/292; 16/294; 16/296; 16/297; 16/382; 403/330

[58] Field of Search ..... 16/238, 245, 246, 255, 16/258, 288, 291, 294, 296, 302, 292, 297, 382; 403/330

[56] References Cited

U.S. PATENT DOCUMENTS 4,430,771 2/1984 Salice ..... 16/258
4,620,343 11/1986 Grass ..... 16/236
4,680,830 7/1987 Rock et al. ..... 16/382
4,691,408 9/1987 Rock et al. ..... 16/382

FOREIGN PATENT DOCUMENTS 2513089 10/1975 Fed. Rep. of Germany .
8602402 4/1986 PCT Int'l Appl. .

*Primary Examiner*—Nicholas P. Godici
*Assistant Examiner*—Edward A. Brown
*Attorney, Agent, or Firm*—James E. Nilles

[57] ABSTRACT

A hinge of the type wherein a rotor is connected to a front part of a base by link arms in such a manner as to be capable of rotating with respect to the base, and the base is fitted to the fitting member which is fitted to the main body of furniture. The base is provided with a set screw having a ring-like engagement portion at the tip thereof, an elongated hole, and a sliding member having hook portions and pawl portions fitted by a screw inserted through the elongated hole. The fitting member is provided with a notch to which the ring-like engagement portion of the set screw engages from forward side, recesses with which the hook portions of the sliding member are engaged, and a lever having grooves engaging with the pawl portions of the sliding member from forward side, urged forward by a spring rotatably.

9 Claims, 4 Drawing Sheets

HINGE

BACKGROUND OF THE INVENTION

1. Field of the Invention

This invention relates generally to a hinge and more particularly to a hinge to be used for the door of furniture, or the like.

2. Description of the Prior Art

In heretofore known hinges of the type wherein a base is connected by rotatable link arms to a rotor to be fitted to the door side of furniture or the like in such a manner that the base can be rotated and opened and closed, and is fitted to the main body of the furniture or the like by a fitting member, the base is fitted to the fitting member which is screwed to the main body, for example, by engagement means such as a pair of screws.

In the hinges of the type described above, the base must be fitted to the fitting member separately from the latter which is fitted to the main body of furniture, by engagement means engaging with both the base and the fitting member such as a pair of screws. Accordingly, the fitting work is troublesome and time consuming.

SUMMARY OF THE INVENTION

In accordance with the present invention, there is provided a hinge having a construction wherein a ring-like engagement portion, hook portions and pawl portions are disposed on a base while notch portions and recess portions are disposed on a fitting member, and a lever urged forward by a spring and having groove portions is disposed rotatably, so that the ring-like engagement portion of the base is engaged with the notch portions of the fitting member, the hook portions of the substrate are then engaged with the recess portions of the fitting member and the pawl portions of the base are engaged with the groove portions of the lever from the forward direction of the groove portions. Accordingly, the base can be fitted easily and reliably to the fitting member and can be removed easily from the fitting member by rotating rearward the lever.

The hook portions and the pawl portions described above are fitted to a sliding member which is in turn fitted to the base by a screw inserted through an elongated hole of the substrate, and this sliding member is moved back and forth so that the position of the base in its longitudinal direction relative to the fitting member can be adjusted.

Another object of the present invention is to obtain a hinge having a construction wherein a stopper is disposed on the lever supporting the base to the fitting member and this stopper restricts the lever in order to prevent the base from falling off accidentally from the fitting member after it is fitted to the latter.

Still another object of the present invention is to obtain a hinge having a construction wherein a cover capable of covering and exposing the operation portion of the lever is disposed so that the base is not removed accidentally from the fitting member after the base is fitted to the fitting member.

These and other objects and novel features of the present invention will become more apparent from the following description when taken in conjunction with the accompanying drawings.

DESCRIPTION OF THE PREFERRED EMBODIMENTS

Figure 1:
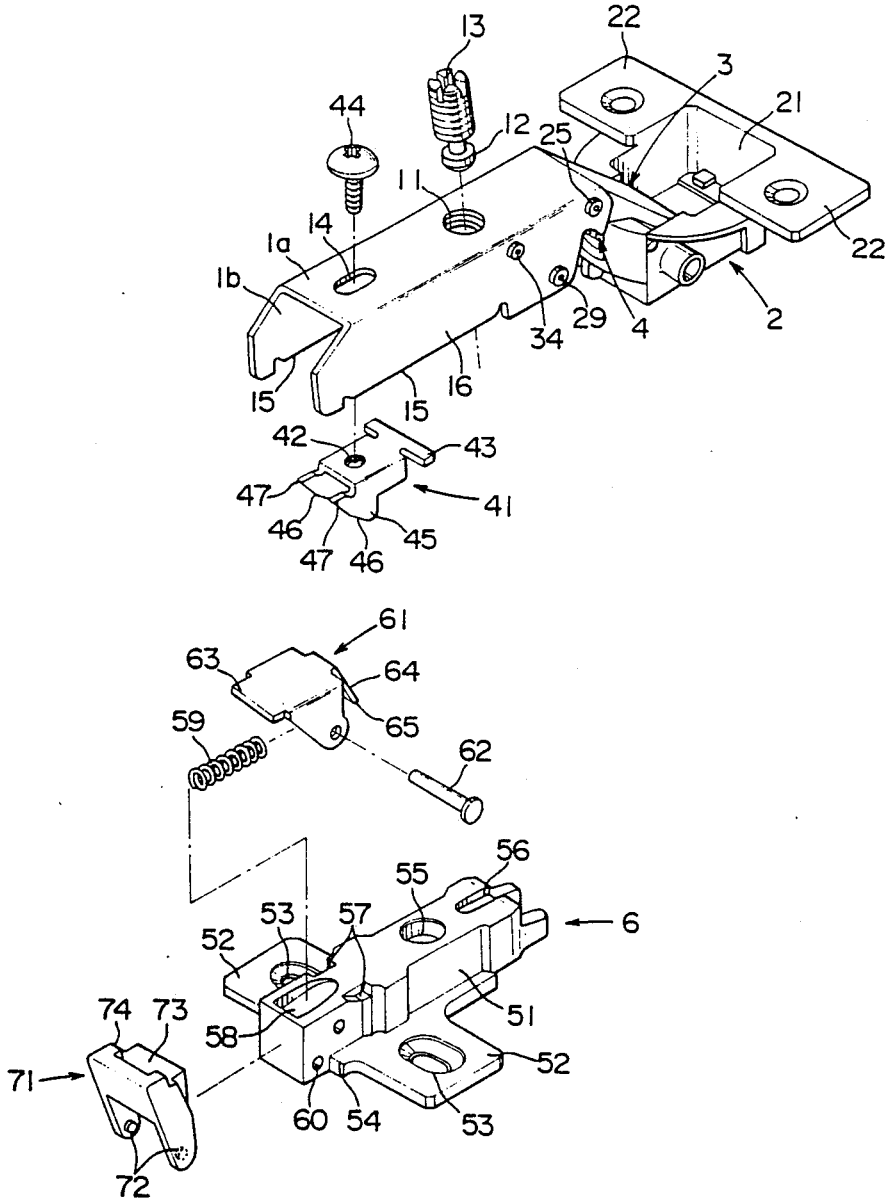
FIG. 1 is an exploded perspective view showing a hinge in accordance with one embodiment of the present invention.
Figure 2:
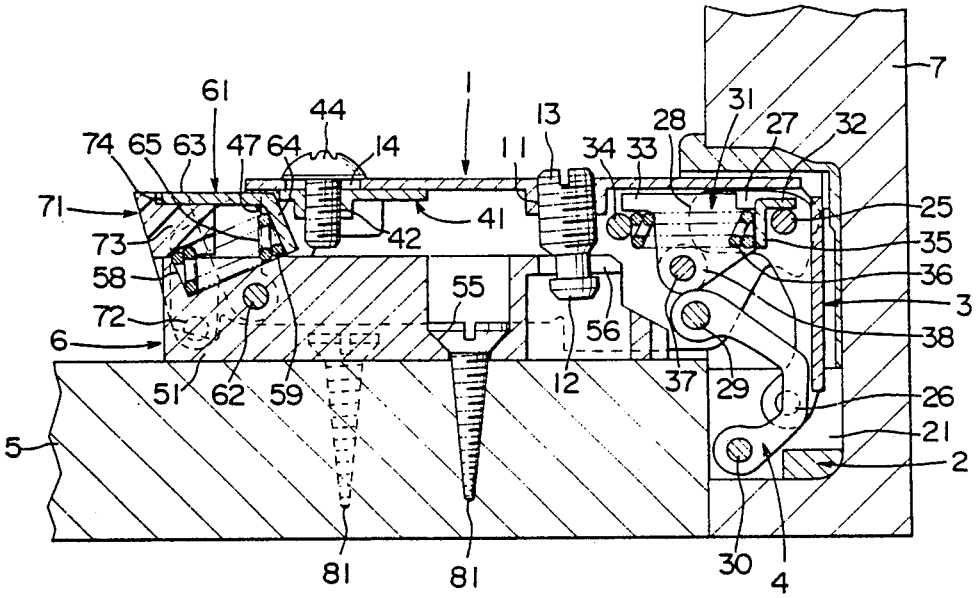
FIG. 2 is a sectional view of the hinge in its closed state.
Figure 4:
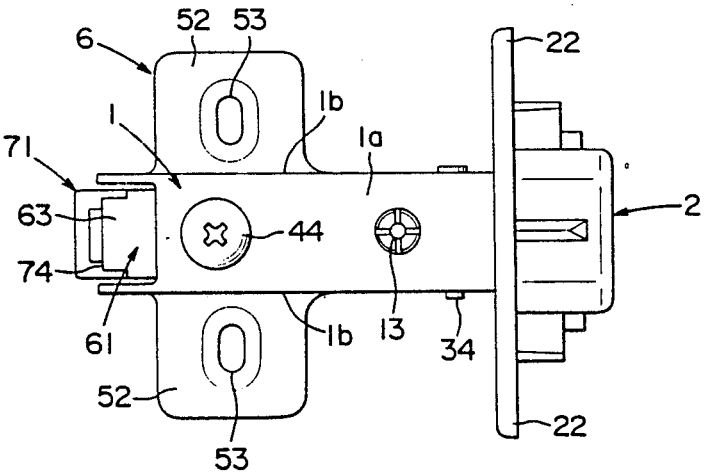
FIG. 4 is a side view of the hinge.
Figure 3:
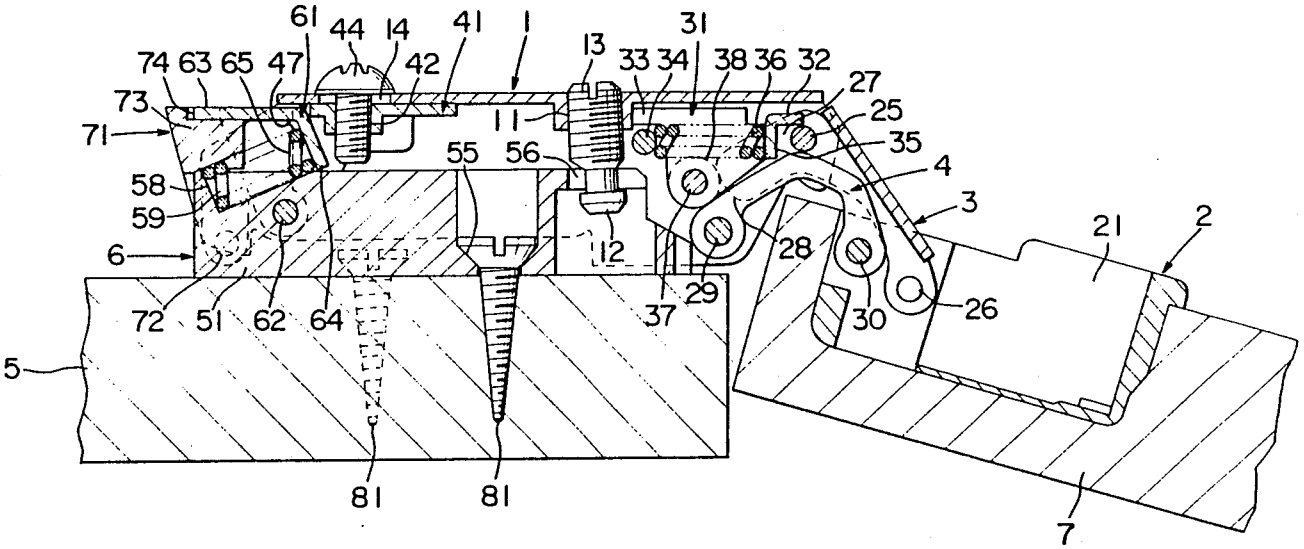
FIG. 3 is a sectional view of the hinge in its open state.

In a hinge shown in FIGS. 1 to 4, a rotor 2 is rotatably connected to a front part of a base 1 by rotatable first and second link arms 3 and 4. The base 1 is fitted to a main body 5 of furniture or the like by a fitting member 6, while the rotor 2 is fitted to a door 7 of the furniture so that the door 7 can be opened and closed relative to the main body 5.

The base 1 is made of a metal and has substantially a U-shaped cross-section in a unitary structure, and a screw hole 11 is bored at the center of a front part of its upper sheet portion 1*a*. A set screw 13 having a ring-like engagement portion 12 at its tip is removably fitted into this screw hole 11. An elongated hole 14 is bored at the rear part of the upper sheet portion 1*a* of the base 1 in such a manner as to extend in a longitudinal direction. Elongated notches 15 are formed at the lower edge portions of both side sheet portions 1*b* of the base 1, respectively.

The rotor 2 is shaped integrally from a metal or the like and a recess 21 whose one surface is open is formed on the rotor, and sheet-like fitting portions 22 project sideways of the open surface of the recess 21. The rotor 2 is buried in the door 7 of the furniture or the like and the fitting portions 22 are set to the door 7 by screws.

The first link arm 3 is shaped from a metal or the like in substantially a U-shaped cross-section and its base end portion is pivotally fitted to the upper part of the front end portion of the base 1 by a shaft 25. The tip of the first link arm 3 is pivotally fitted into the recess 21 of the rotor 2 by another shaft 26. Extension portions 27 are formed on both sides of the base end portion of this first link arm 3 in such a manner as to be bent almost at right angles and extend rearward from near the shaft 25, respectively, and are brought into sliding contact with the inner surfaces of both side sheet portions 1*b* of the base 1. A cam surface 28 is formed on the rear surface of each of these extension portions 27.

The second link arm 4 is formed by, for example, bonding a plurality of bent metal sheets having the same shape, and its base end portion is rotatably fitted to the lower part of the front end portion of the base 1 by a shaft 29. The tip of the second link arm 4 is rotatably fitted into the recess 21 of the rotor 2 by a shaft 30.

A slider 31 is shaped from a metal sheet or the like, and has a substantially U-shape when viewed from above. Guided portions 32 and 33 are formed at the upper part of the front and rear end portions of the slider 31 in such a manner as to project therefrom. The guided portion 32 at the front portion is inserted into a gap between the upper sheet portion 1*a* of the base 1 and the shaft 25, while the guided portion 33 at the rear portion is inserted into a gap between the upper sheet portion 1*a* and a shaft 34 which is positioned at the rear of the shaft 25 and disposed on the base 1. Accordingly, the slider 31 is supported inside the base 1 so that it can slide in the longitudinal direction within a predetermined range.

A coil spring 36 is interposed between the rear shaft 34 and a front surface sheet 35 of the slider 31 in order to always urge the slider 31 forward. A shaft 37 extends between the lower parts of both side surfaces of the slider 31 in such a manner as to extend outward from both side surfaces. Rollers 38 are rotatably supported at both end portions of this shaft 37. These rollers 38 are brought into sliding contact with the inner surfaces of both side sheet portions 1*b* of the base 1. Furthermore, the rollers 38 come into contact with the cam surfaces 28 of both extension portions 27 of the first link arm 3, respectively. Since the spring 36 urges the first link arm 3 through the slider 31 and the rollers 38, the rotor 2 can be kept closed.

Reference numeral 41 represents a sliding member, which is shaped from a metal sheet or the like in a substantially sheet-like shape, and a screw hole 42 is bored on its upper surface. The front portion of this sliding member 41 is shaped as a guided portion 43 which is wider than the sliding member 41. While both end portions of the guided portions 43 are brought into contact with the inner surface of both side sheet portions 1*b* of the base 1, a screw 44 is inserted into the screw whole 42 of the sliding member 41 through the elongated hole 14 of the base 1 so that the sliding member 41 can slide in a longitudinal direction inside the base 1 within a predetermined range. Hook portions 45 are formed at the rear parts of both side portions of this sliding member 41 so as to extend downward and integrally from the sliding member 41. The rear edge of each hook portion 45 is tapered in such a manner as to form a taper portion 46 that rises rearward.. A tongue-like pawl 47 is formed at the rear part of each hook portion 45 in such a manner as to project rearward.

The fitting member 6 is shaped from a metal or the like, and consists of a main body portion 51 having a substantially rectangular shape and sheet-like fitting plate portions 52 that project on both sides of the main body portion 51, respectively. The maximum width of the main body portion 51 is substantially equal to the distance between the inner surfaces of both side sheet portions 1*b* of the base 1.

A through-hole 53 that extends to the right and left is bored on each of the fitting plate portions 52 described above. A restriction portion 54 which is somewhat shorter than the notch portion 15 of the base 1 is formed at the base part of each of these fitting plate portions 52.

On the other hand, a through-hole 55 is bored at the center of the main body portion 51, too. The front end part of the main body portion 51 is hollow, and a notch portion 56 whose front part is expanded is formed at the upper front part of the main body portion 51. Recesses 57 are formed at both rear side parts of the main body portion 51 so that the hook portions 45 of the sliding member 41 are fitted thereto from above and mesh with them, respectively. A storage hole 58 is bored at the rear part of the main body and at the rear of these recesses 57 in such a manner as to rise forward, and a coil spring 59 is stored in this storage hole 58. Bearing holes 60 are bored at both rear side parts of the main body portion 51 below the storage hole 58.

Reference numeral 61 represents an operation lever, which is shaped from a metal sheet or the like. This lever has a substantially U-shape when viewed from the front. The lever 61 is rotatably supported at its lower end part to the rear part of the main body portion 51 of the fitting member 6 by a shaft 62. A projected operation portion 63 is formed at the rear part of the upper surface of the lever 61, while a restriction plate 64 is bent downward at the front part of the upper surface of the lever 61. The front end of the spring 59 described above is brought into contact with this restriction plate 64 so that the lever 61 is always urged forward by the spring 59. When the lower end of the restriction plate 64 is brought into contact with the upper surface of the main body portion 51, the range of rotation of the lever 61 is restricted. Furthermore, the gaps between both side edges of the restriction plate 64 and the front edges of both side surfaces of the lever 61 define groove portions 65 with which the pawl portions 47 of the sliding member 41 engage, respectively.

Incidentally, the structure of the lever 61 can be more simplified because the restriction plate 64 restricting the range of rotation is used also as a receiving portion of the spring 59.

Reference numeral 71 represents a stopper, which is shaped from a synthetic resin or the like and has a substantially U-shape when viewed from its front surface. A pair of shaft portions 72 are formed at the lower end portions of both side surfaces of the stopper 71 in such a manner as to project and oppose each other. The shaft portions 72 of the stopper 71 are fitted to the end portions of the bearing holes 60 of the fitting member 6, thereby supporting rotatably the fitting member 6. An engagement portion 73 projecting forward is formed at the upper part of the stopper 71, and a step portion 74 is formed at the back of the upper surface of the engagement portion 73.

The hinge of the invention can be fitted to the furniture or the like in the following way. Namely, the main body 5 is fitted to the fitting member 6 by setting wood screws 81 to the main body 5 of the furniture or the like through the through-holes 53, 55 of the fitting member 6.

At this time, the stopper 71 is rotated rearward and its engagement portion 73 is positioned at the back of the fitting member 6.

Next, the base 1 is fitted to the fitting member 6. For this purpose, the base 1 is first put on the main body portion 51 of the fitting member 6 in such a manner as to cover the main body portion 51 from its front portion, and the ring-like engagement portion 12 of the set screw 13 of the base 1 is engaged with the notch portion 56 of the fitting member 6 from the forward direction. Then, the rear part of the base 1 is pushed to the fitting member 6. Accordingly, the taper portions 46 of the hook portions 45 of the sliding member 41, that is fitted to the base 1, push the front edge of the upper surface of the lever 61 and rotate it rearward against the force of the spring 59, and the hook portions 45 override the upper surface of the lever 61. At the same time, the pawl portions 47 of the sliding member 41 engage with the groove portions 65 of the lever 61, that is urged forward by the spring 59, from the forward direction and the hook portions 45 of this sliding member 41 are fitted into the recesses 57 of the fitting member 6. Incidentally, the restriction portions 54 of the fitting member 6 are positioned inside the notch portions 15 of the base 1, respectively.

Under the state described above, the ring-like engagement portion 12 of the base 1 engages with the notch portion 56 of the fitting member 6, the pawl portions 47 on the side of the base 1 engage with the groove portions 65 urged by the spring 59 on the side of the fitting member 6 and the hook portions 45 on the side of the base 1 engage with the recesses 57 on the side of the fitting member 6. Accordingly, the base 1 is firmly fixed to the fitting member 6 while its loose movement in any direction is reliably inhibited. Moreover, particularly because the notch portions 56 and the recesses 57 are formed on the fitting member 6 itself that is directly fixed to the main body 5 of the furniture or the like, the fitting state of the base 1 becomes all the more reliable.

Since the base 1 can be fitted to the fitting member 6 by merely covering the fitting member 6, the fitting work can be made extremely easily in one-touch operation.

Next, the stopper 71 is rotated forward and its engagement portion 73 is fitted into the gap between the upper surface of the fitting member 6 and the operation portion 63 of the lever 61. At this time, the rear edge of the operation portion 63 comes into contact with the step portion 74 of the stopper 71. Under this state the lever 61 is restricted by the stopper 71. Therefore, even if one touches accidentally the operation portion 63 of the lever 61, the lever 61 does not move so that the base 1 does not come off from the fitting member 6.

Since the engagement portion 73 of the stopper 71 is clamped by the lever 61 and the fitting member 6 and restricts the lever 61, the structure of the stopper 71 can be simplified.

When the set screw 13 is rotated and moved back and forth relative to the base 1, the angle of the base 1 relative to the fitting member 6 can be adjusted.

The position of the base 1 in the longitudinal direction relative to the fitting member 6 can be adjusted, too, by loosening the screw 44 for the sliding member 41 and sliding this screw 44 inside the elongated hole 14 of the base 1, that is to say, by moving back and forth the base 1 with respect to the sliding member 41 that is fixed to the fitting member 6. Needless to say, the screw 44 is again tightened to fix the sliding member 41 to the base 1 after the adjustment is complete.

The base 1 can be removed from the fitting member 6 by rotating rearward the stopper 71 and pulling out its engagement portion 73 from between the lever 61 and the fitting member 6, and then pushing the operation portion 63 of the lever 61, whereby the pawl portions 47 of the sliding member 41 come off from the groove portions 65 of the lever 61 due to the rotation of the lever 61, the upper sheet portion 1*a* of the base 1 is pushed to the front end portion of the upper surface of the lever 61 to remove the rear part of the base 1 from the fitting member 6 and the hook portions 45 of the sliding member 41 come off from the recesses 57. Next, when the base 1 is pulled forward, its ring-like engagement portion 6 disengages from the notch portion 56 of the fitting member 6. In this manner, the base 1 can be removed from the fitting member 6 very easily.

Incidentally, the stopper 71 may be disposed separately from the fitting member 6 or the like, but if it is rotatably supported by the fitting member 6 or by the base 1, the stopper 71 can be operated very easily.

Figure 5:
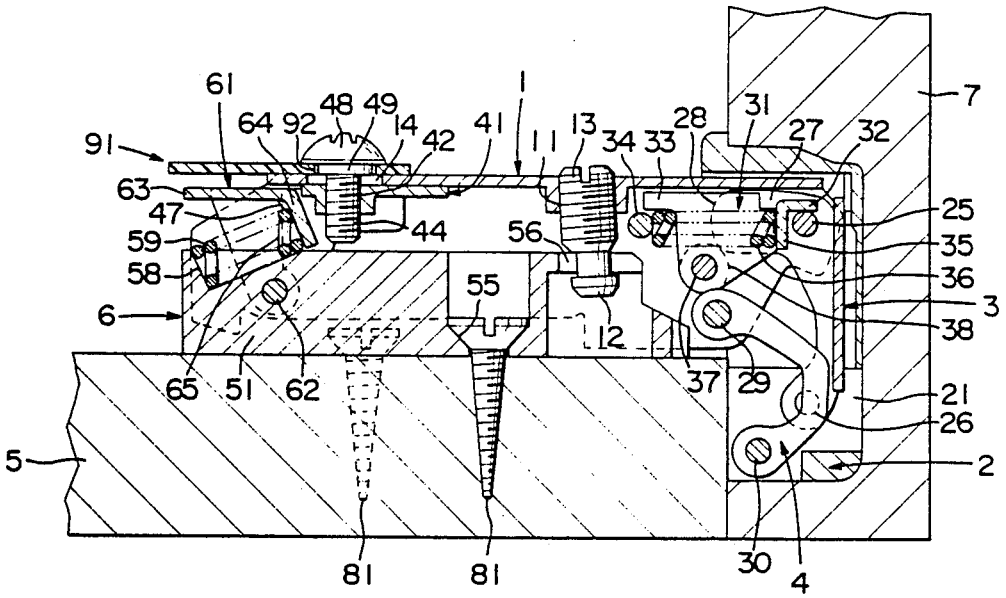
FIG. 5 is a sectional view of a hinge in accordance with another embodiment of the present invention.

Next, another embodiment of the present invention will be described with reference to FIGS. 5 and 6.

In this embodiment, a cover 91 which can cover and expose the operation portion 63 of the lever 61 is disposed in place of the stopper 71 of the foregoing embodiment.

An increased diameter portion 49 having a columnar shape is formed below a head 48 of the screw 44 for fitting the sliding member 41 to the base 1 and the lower surface of this increased diameter portion 49 comes into contact with the upper surface of the base 1.

The cover 91 is shaped in a rectangular sheet and a through-hole 92 is bored on one side of the cover 91 in its longitudinal direction. The increased diameter portion 49 of the screw 44 is fitted into the through-hole 92 of the cover 91 and since the cover 91 is clamped between the head 48 of this screw 44 and the upper sheet portion 1*a* of the base 1, the cover 91 is rotatably supported on the upper surface of the base 1 at an arbitrary position.

After the base 1 is thus fitted to the fitting member 6, the cover 91 is rotated in order to cover the operation portion 63 of the lever 61 from above. Under this state, one cannot touch the operation portion 63 of the lever 61 so that the base 1 does not accidentally come off from the fitting member 6.

Figure 6:
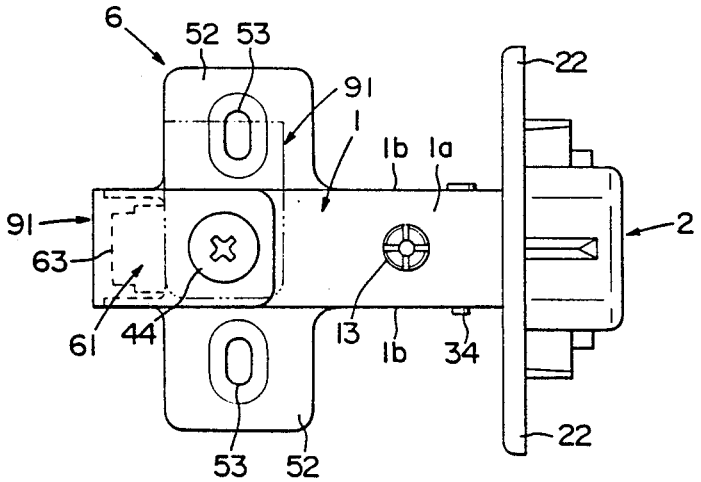
FIG. 6 is a side view of the hinge shown in FIG. 5.

To remove the base 1 from the fitting member 6, the cover 91 is rotated to the position indicated by dash lines in FIG. 6 so as to expose the operation portion 63 of the lever 61.

Although the cover 91 may be removably disposed on the base 1, for example, the cover 91 can be operated more easily if it is rotatably supported by the base 1 or the fitting member 6.

What is claimed is:

1. In a hinge of the type wherein a rotor is connected to a front part of a base by link arms in such a manner as to be capable of rotating with respect to the base, and said base is fitted to the main body of the furniture or the like by a fitting member, the improvement characterized by comprising:

a set screw equipped with a ring-like engagement portion at the tip thereof and fixed to the front part of said base;

an elongated hole formed at a rear part of said base in such a manner as to extend in a longitudinal direction;

a sliding member equipped with hook portions and pawl portions and fitted to said base by a screw inserted through said elongated hole;

a notch formed on said fitting member so that said ring-like engagement portion of said set screw engages with said notch from forward side;

recesses formed on said fitting member in such a manner as to engage with said hook portions of said sliding member; and a lever having grooves engaging with said pawl portions of said sliding member from the forward side, urged forward by a spring and rotatably disposed on said fitting member.

2. The hinge as defined in claim 1 wherein said sliding member is equipped with a taper portion in the vicinity of said pawl portions thereof which taper portion pushes said lever and rotates it rearward when said sliding member is fitted to said fitting member of said base.

3. The hinge as defined in claim 1 wherein said lever is disposed at a position where it pushes said base and separates it from said fitting member when it is rotated rearward.

4. The hinge as defined in claim 1 wherein said lever has a restriction plate which is brought into contact with said fitting member and restricts the range of rotation of said lever, and one of the ends of said spring is brought into contact with said restriction plate.

5. In a hinge of the type wherein a rotor is connected to a front part of a base by link arms in such a manner as to be capable of rotating with respect to the base, and said base is fitted to the main body of the furniture or the like by a fitting member, the improvement characterized by comprising:

a set screw equipped with a ring-like engagement portion at the tip thereof and fixed to the front part of said base;

an elongated hole formed at a rear part of said base in such a manner as to extend in a longitudinal direction;

a sliding member equipped with hook portions and pawl portions and fitted to said base by a screw inserted through said elongated hole;

a notch formed on said fitting member so that ring-like engagement portion of said set screw engages with said notch from forward side;

recesses formed on said fitting member in such a manner as to engage with said hook portions of said sliding member;

a lever having grooves engaging with said pawl portions of said sliding member from the forward side, urged forward by a spring and rotatably disposed on said fitting member, and a stopper which is engageable with said lever to restrict movement of said lever and disengageable from said lever.

6. The hinge as defined in claim 5 wherein said stopper is interposed between said lever and said fitting member and restricts rotation of said lever.

7. The hinge as defined in claim 5 wherein said stopper is rotatably supported by said base or said fitting member.

8. In a hinge of the type wherein a rotor is connected to a front part of a base by link arms in such a manner as to be capable of rotating with respect to the base, and said base is fitted to the main body of the furniture or the like by a fitting member, the improvement characterized by comprising:

a set screw equipped with a ring-like engagement portion at the tip thereof and fixed to the front part of said base;

an elongated hole formed at a rear part of said base in such a manner as to extend in a longitudinal direction;

a sliding member equipped with hook portions and pawl portions and fitted to said base by a screw inserted through said elongated hole;

a notch formed on said fitting member so that said ring-like engagement portion of said set screw engages with said notch from forward side;

recesses formed on said fitting member in such a manner as to engage with said hook portions of said sliding member;

a lever having grooves engaging with said pawl portions of said sliding member from the forward side, urged forward by a spring and rotatably disposed on said fitting member and an operation portion; and a cover mounted on said hinge and positionable to either cover or expose said operation portion.

9. The hinge as defined in claim 8 wherein said cover is supported for rotation about an axis that extends at rights angles from said base or said fitting member.

* * * * *